United States Patent [19]

Wei

[11] Patent Number: 4,991,724

[45] Date of Patent: Feb. 12, 1991

[54] STRUCTURE OF RACK ASSEMBLY

[76] Inventor: Chih-Yen Wei, No. 225, She Chung Street, Shihlin District, Taipei, Taiwan

[21] Appl. No.: 473,454

[22] Filed: Feb. 1, 1990

[51] Int. Cl.[5] ..... A47F 5/00

[52] U.S. Cl. ..... 211/87; 211/65; 211/90; 211/105.1; 211/99

[58] Field of Search ..... 211/87, 90, 65, 105.1, 211/90, 105.2, 99, 100, 66; D6/528, 534, 546, 548, 549

[56] References Cited

U.S. PATENT DOCUMENTS

| | | | |
|---|---|---|---|
| 3,141,712 | 7/1964 | Holmes et al. | 211/66 X |
| 3,777,894 | 12/1973 | Swenson | 211/99 X |
| 4,625,873 | 12/1986 | Hayashi | 211/100 X |
| 4,753,355 | 6/1988 | Hall et al. | 211/105.1 |
| 4,870,907 | 10/1989 | McKee | 211/90 X |
| 4,890,808 | 1/1990 | Ford | 211/105.1 X |

FOREIGN PATENT DOCUMENTS

| | | | |
|---|---|---|---|
| 1199165 | 12/1959 | France | D6/546 |

*Primary Examiner*—Robert W. Gibson, Jr.
*Attorney, Agent, or Firm*—Bacon & Thomas

[57] ABSTRACT

A rack assembly for holding towels, toothbrushes and other things, which includes two fastening elements secured to a wall by screw nails for the connection thereto of two couplers via two connectors for the connection therebetween of a cross rod therebetween to support two frame plates, and for the connection thereto of two supporting rods permitting two suspension rods to be secured between the two supporting rods by means of two upper struts and two lower struts. A cylindrical toothbrush holder is releasably hung on either one of the two couplers, and comprises access doors through which toothbrushes can be placed in the holder plates thereof.

7 Claims, 9 Drawing Sheets

STRUCTURE OF RACK ASSEMBLY

BACKGROUND OF THE INVENTION

This invention relates to a structure of rack assembly for holding towels, toothbrushes and other things.

Conventionally, there are various types of towel rails or other device been used for holding towels, and the disadvantages of which are outlined hereinafter.

(1) Towel hanging hook: It is easy to break or drop from a wall when few more towels are mounted thereon;

(2) Towel suspension rod: The fastening element which secures a rod to a wall is easy to break, and the rod can be available only for a limited pieces of towels to hang thereon; and (3) Extension rod type towel rail: In this type of towel rail, high supporting strength is difficult to achieve, and the both ends of an extension rod type towel rail can not be stably secured to support heavy load.

A rack assembly for holding towels and toothbrushes in accordance with the present invention provides numerous features as outlined hereinafter.

(1) Simple structure, easy to assemble or dismount;

(2) Screw nail fastening ensures maximum security;

(3) High loading capacity;

(4) High versatility; It can hold clothes towels, toothbrushes and may other things;

(5) The whole structure is secured to a wall by means of fastening elements via connectors through sleeve-joint and reinforced by a spring to enhance the binding force and facilitate its dismounting;

(6) Unique toothbrush holder for holding a variety of toothbrushes to protect against contamination; and (7) Fastening elements can be secured to a wall or other object at any angle without interfering the installation of the whole structure.

SUMMARY OF THE INVENTION

This invention provides a rack assembly for holding towels, toothbrushes and other things which includes two fastening elements secured to a wall by screw nails for the connection thereto of two couplers via two connectors for the connection therebetween of a cross rod therebetween to support two frame plates, and for the connection thereto of two supporting rods permitting two suspension rods to be secured between the two supporting rods by means of two upper struts and two lower struts. A cylindrical toothbrush holder is releasably hung on either one of the two couplers, and comprises access doors through which toothbrushes can be placed in the holder plates thereof.

Figure 1:
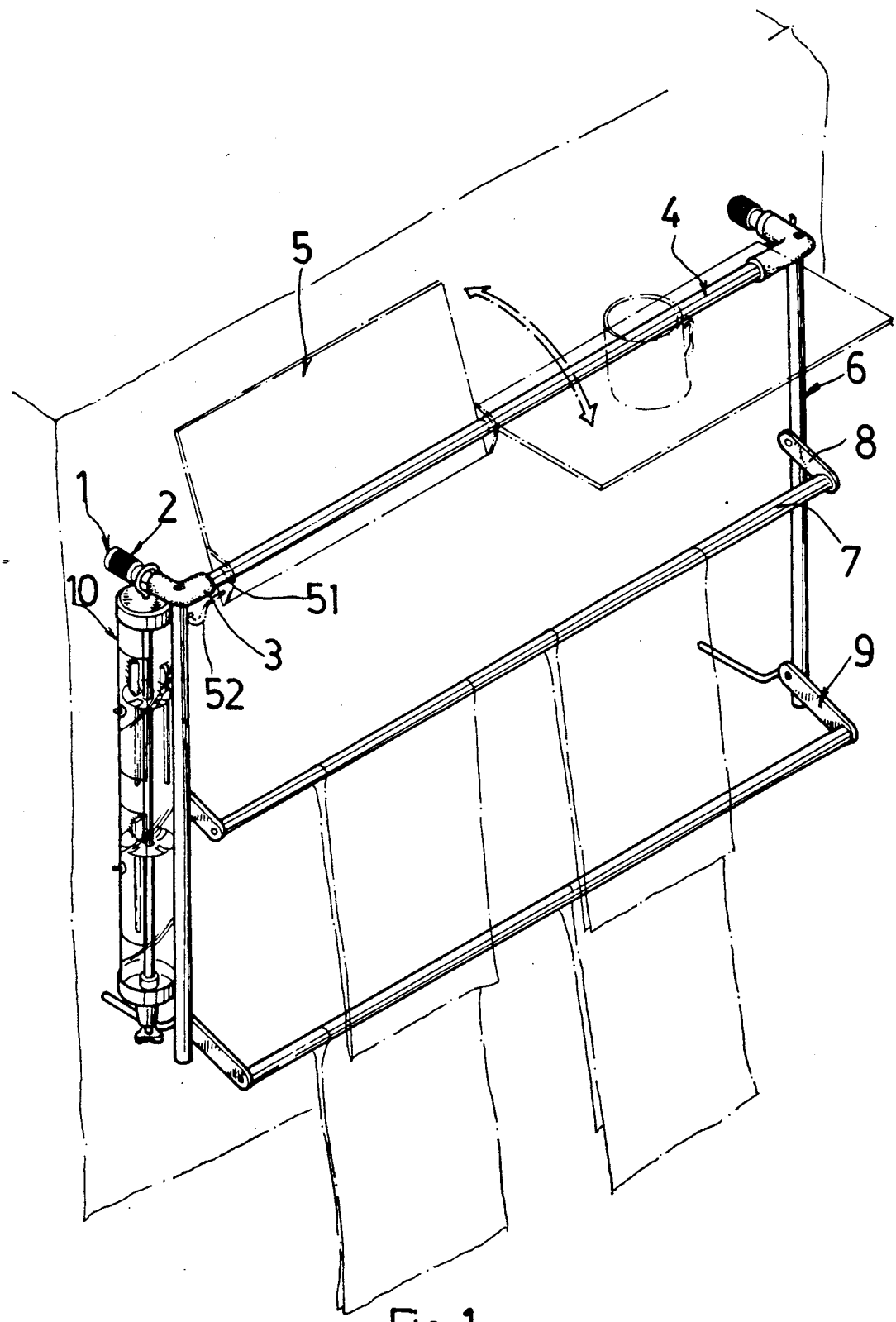
FIG. 1 is a perspective view of a rack assembly embodying the present invention.

DETAILED DESCRIPTION OF THE PREFERRED EMBODIMENTS:

Turning now to the annexed drawings in greater detail, therein illustrated is a rack assembly in accordance with the present invention and generally comprised of fastening element (1), connector (2), coupler (3), cross rod (4), frame plate (5), supporting rod (6), suspension rod (7), upper strut (8) lower strut (9), and toothbrush holder (10).

Figure 2:
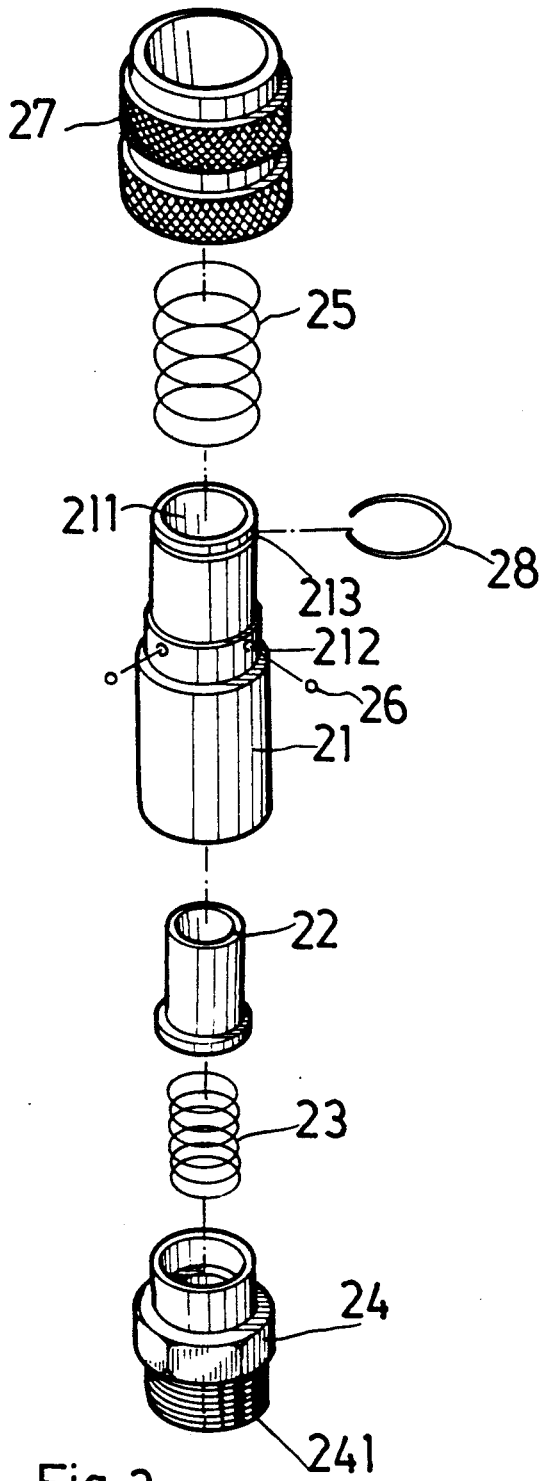
FIG. 2 is a fragmentary perspective view of a connector according to the present invention.

With reference to FIG. 2, a connector (2) comprises a stepped socket (21) having small pivot holes (212) for the setting therein of a steel ball (26) each, and a front sleeve (211) which comprises a circular groove (213) having a C-retainer (28) clamped thereon to secure a second spring (25) and a cap (27). A pressure element (22) and a first spring (23) are inserted in the stepped socket (21) opposite to its front sleeve (211) and firmly secured therein by a holder (24) which comprises an outer thread (241) on its one end.

With reference to FIG. 1, a frame plate (5) is mounted on a cross rod (4) by means of its axle hole (51), and firmly secured to a coupler (3) by means of a hook member (52), which is unitarily made thereon at its one side, to prevent from swirling down.

Figure 3:
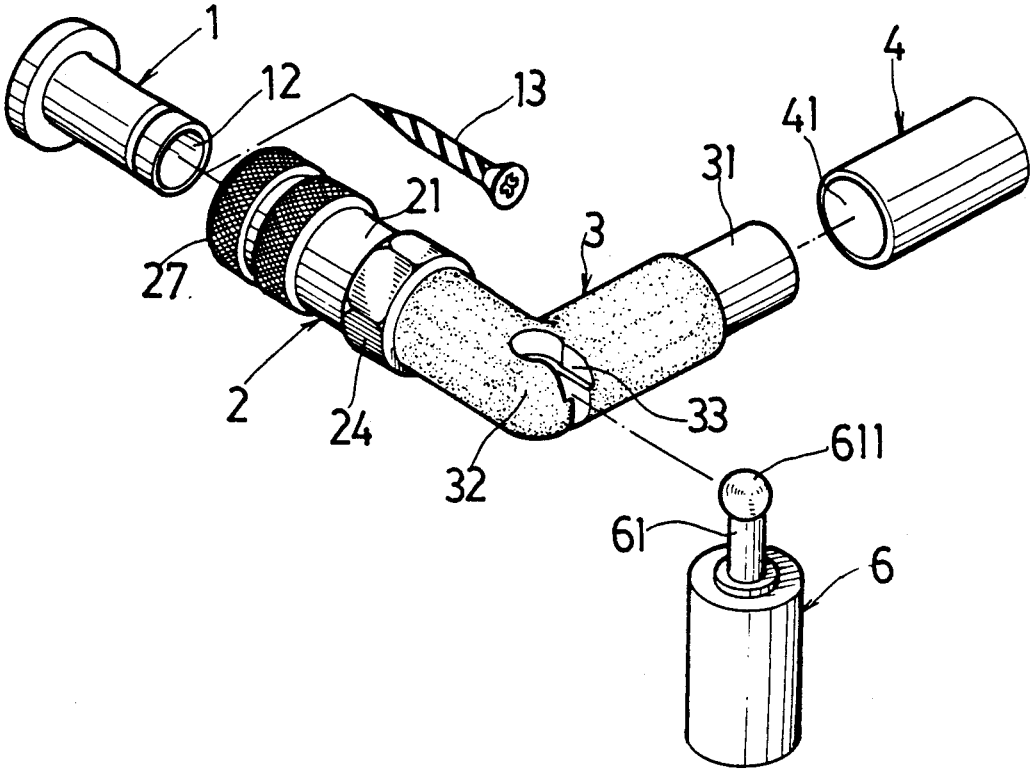
FIG. 3 is a schematic drawing illustrating the relative positioning of a fastening element, connector, coupler, cross rod and a supporting rod.
Figure 4:
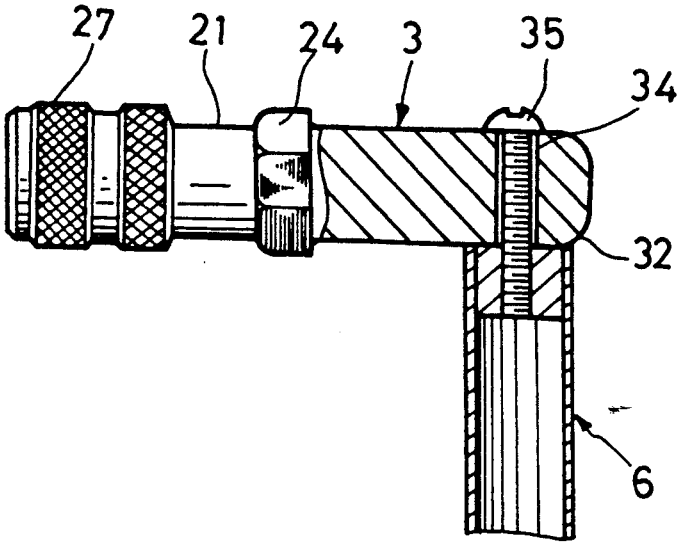
FIG. 4 illustrates the connection of a supporting rod to a coupler.
Figure 5:
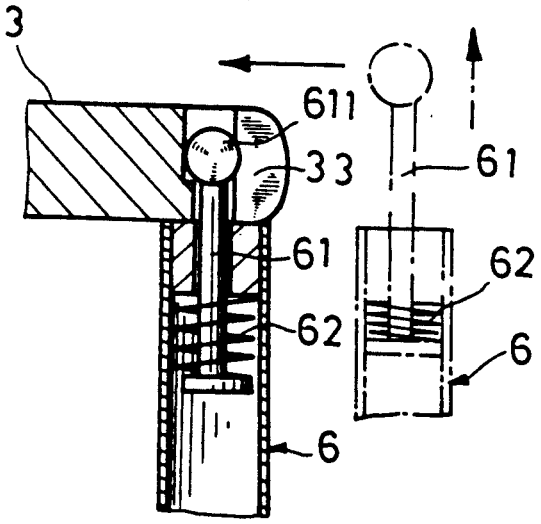
FIG. 5 illustrates an alternate form of the connection of a supporting rod to a coupler.

With reference to FIG. 3, a screw nail (13) is inserted through the axle hole (12) of a fastening element (1) to fixedly fasten such a fastening element (1) to a wall. A coupler (3) of the present invention is a L-shaped element having a bolt hole (not shown) at its one end for the connection with the outer thread (241) of a connector (2), and a sleeve portion (31) at its other end for inserting in the boring bore (41) of a cross rod (4). The middle part of a coupler (3) of the present invention defines a quarter turn (32). A supporting rod (6) can be secured to a coupler (3) by either of the following two ways. As illustrated in FIG. 4, a positioning hole (34) is made on the quarter turn (32) of a coupler (3) for the insertion therein of a screw bolt (35) to secure a supporting rod (6) to a coupler (3). A second way to secure a supporting rod (6) to a coupler (3) is as illustrated in FIGS. 3 and 5, in which a T-shaped groove (33) which includes a circular hole at its inner portion is made on the quarter turn (32) for securing a supporting rod (6). The supporting rod (6) comprises therein a pull rod (61) having a ball head (611) and being flexibly secured by a spring (62). When the pull rod (61) is pulled upward, it can be set in the circular hole of the T-shaped groove (33), and the spring (62) will immediately draw back the pull rod (61) permitting the ball head (611) of the pull rod (61) to be firmly retained in the T-shaped groove (33). Referring to FIGS. 2 and 3 again, after a connector (2), a coupler (3), a cross rod (4) and a supporting rod (6) are respectively connected together, the connector (2) is mounted on a fastening element (1) which is secured to a wall, permitting the steel balls (26) of the connector (2) to partly protrude beyond the pivot holes (212) into the boring bore of the front sleeve (211) to seat in a circular groove (13) on the fastening element (1). Simultaneously, the second spring (25) of the coupler (2) forces the cap (27) to move outward to enhance the engagement of the steel balls (26) in the circular groove (13) of the fastening element (1).

Figure 6:
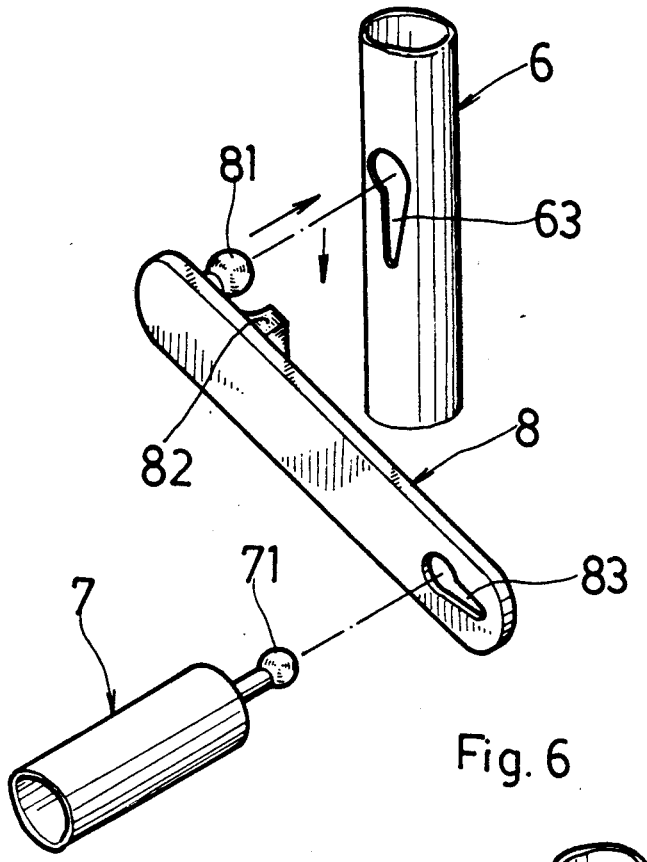
FIG. 6 illustrates the connection of a suspension rod to a supporting rod by means of an upper strut.
Figure 7:
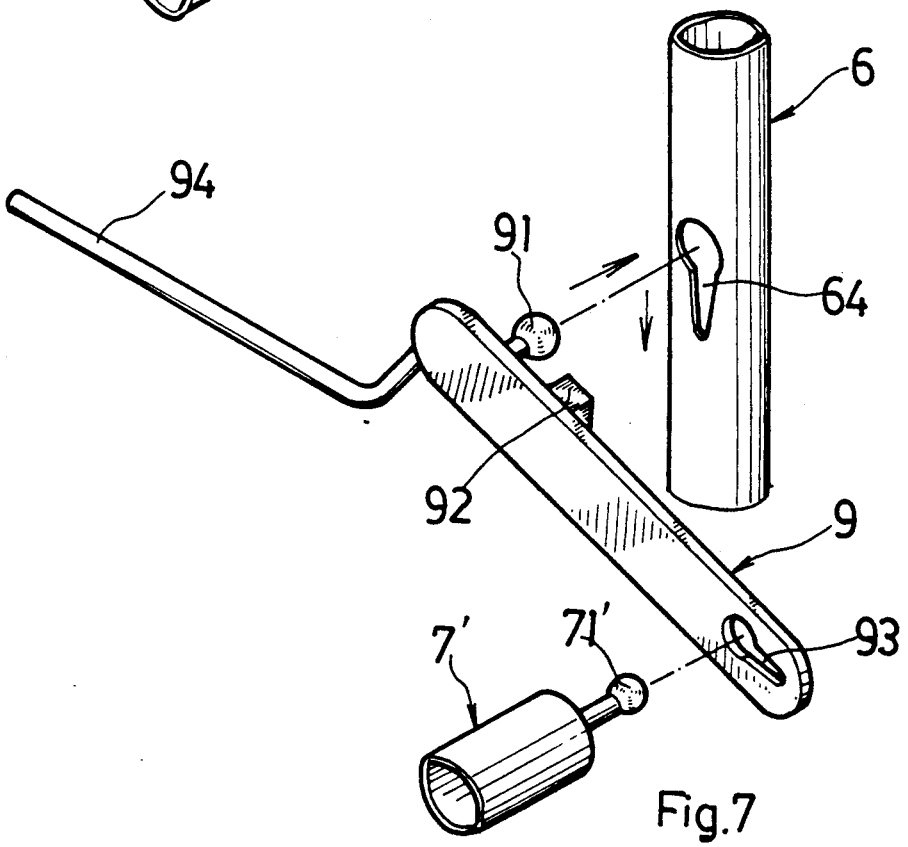
FIG. 7 illustrates the connection of a suspension rod to a supporting rod by means of a lower strut.
Figure 8B:
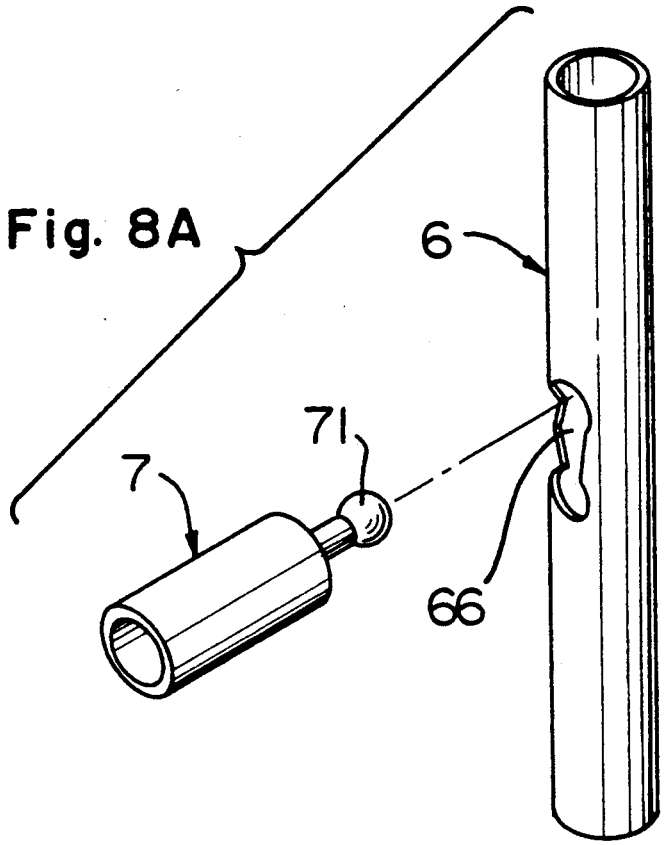
FIG. 8 illustrates an alternate form of the connection of a suspension rod to a supporting rod.
Figure 8B:
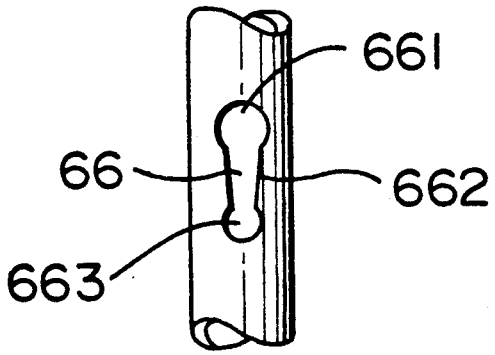

FIGS. 6 and 7 illustrate the connection of a suspension rod (7) to a supporting rod (6) via an upper strut (8). and the connection of a suspension rod (7) to a supporting rod (6) via a lower strut (9). The supporting rod (6) comprises a key hole notch (63) at an upper location and another key hole notch (64) at a lower position. The upper strut (8) and the lower strut (9) comprise each a ball head portion (81) or (91) respectively secured in the key hole notches (63) (64) of the supporting rod (6), a key hole notch (83) or (93) for securing the ball head (71) or (71') of a suspension rod (7) or (7') respectively, and a projecting block (82) or (92) stopped against the supporting rod (6) so that the strut (8) or (9) can be maintained in a certain angle of inclination relative to the supporting rod (6). The lower strut (9) further comprises a lever bracket (94) stopped against a wall to stabilize the structure. FIG. 8 illustrates an alternate form of the connection of a supporting rod (6) with a suspension rod (7). As illustrated a supporting rod (6) has a notch (66) thereon which is comprised of a larger opening (661) at the top, a smaller opening (663) at the bottom, and a downward reducing neck portion (662) in the middle to communicate the larger opening (661) with the smaller opening (663). During assembly, the ball head (71) of a suspension rod (7) is inserted in the notch (66) from the larger opening (661) and pressed downward through the reducing neck portion (662) into the smaller opening (663) to become firmly retained therein.

Figure 9:
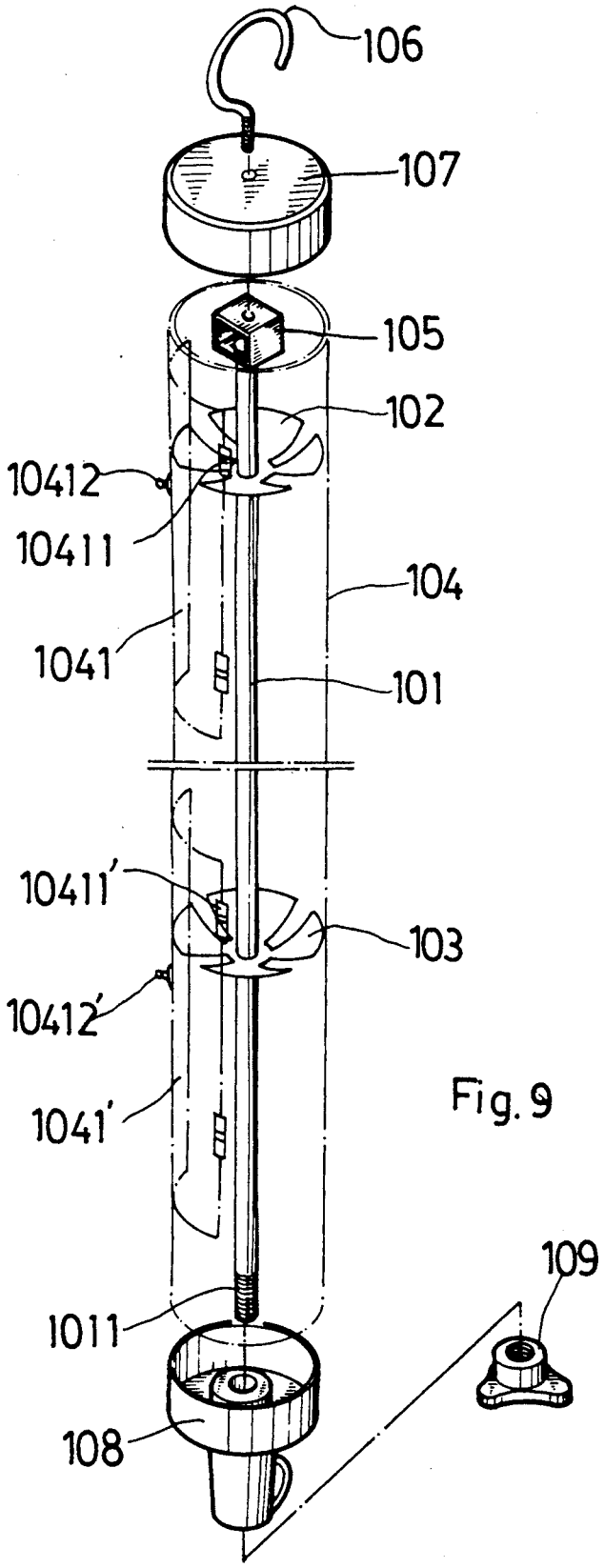
FIG. 9 is a fragmentary perspective view of a toothbrush holder according to the present invention.
Figure 10:
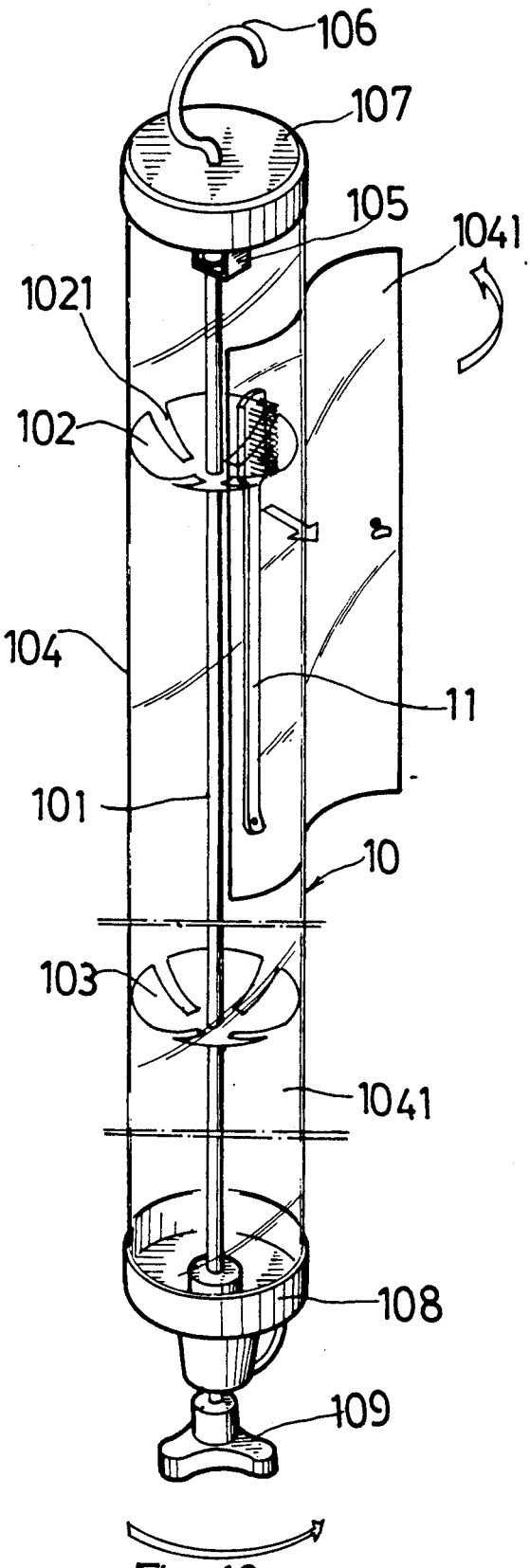
FIG. 10 illustrates the moving direction of the toothbrush holder when it is turned to rotate.
Figure 11:
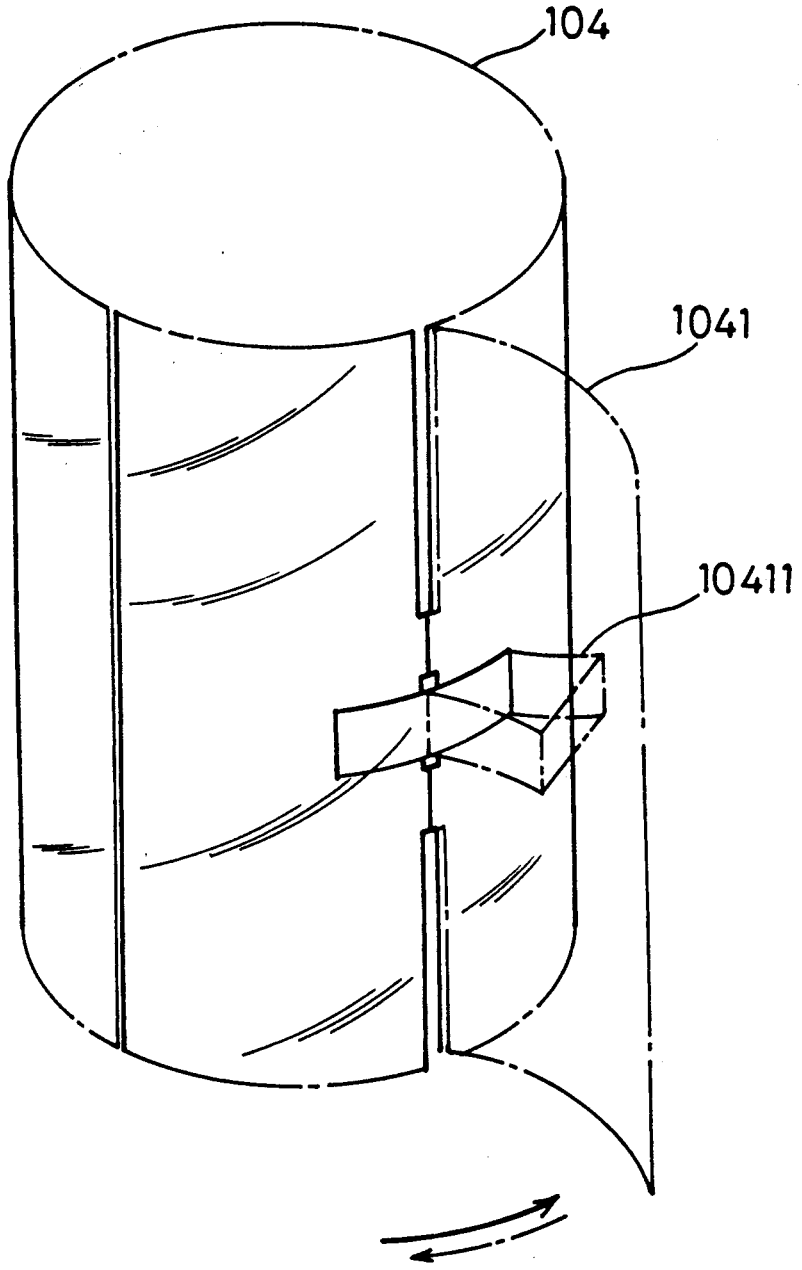
FIG. 11 is a partly enlarged view of the toothbrush holder, illustrating the structure of the access door.

Referring to FIGS. 9 and 10 a toothbrush holder (10) comprises an axle (101) received in a transparent cylindrical shell (104) and having mounted thereon a first holder plate (102) at an upper position and a second holder plate (103) at a lower position. The axle (101) comprises a block (105) at its top end for the connection thereto of a hook bolt (106) to secure an upper cap (107) to the top end of the transparent cylindrical shell (104), and an outer thread (1011) on its lower end for the connection thereto of a knob (109) to secure a bottom cap (108) to the bottom end of the transparent cylindrical shell (104). The transparent cylindrical shell (104) comprises two access doors (1041) and (1041') which are connected to the transparent cylindrical shell (104) by means of bent portions (10411) and (10411') which are unitarily made on the transparent cylindrical shell (104) (see FIG. 11). The access doors (1041) and (1041') comprise each a hand-hold (10412) or (10412') for the holding of the hand to open or close the access doors (1041) and (1041'). Referring to FIG. 10, the first and second holder plates (102) and (103) have a structure similar to a conventional fan blade assembly and comprise each a plurality of notches (1021) radially made thereon for holding toothbrushes (11). By means of the knob (109). the axle (101) can be turned to carry the holder plates (102) and (103) to rotate such that one can conveniently select a toothbrush (11) from the various toothbrushes which are mounted on the notches (1021) of the holder plates (102) or (103).

During assembly, the component parts are bilaterally symmetrically disposed to build up a rack assembly as illustrated in FIG. 1.

I claim:

1. A rack assembly for holding towels and toothbrushes, including:

two fastening elements each comprising a circular base having an extension sleeve upstanding therefrom and a fastening hole therethrough, said extension sleeve having a circular groove thereon;

two connectors, each comprising a stepped socket having small pivot holes for the setting therein of a steel ball each, and a front sleeve which comprises a circular groove haVing a C-retainer clamped thereon to secure a second spring and a cap, a pressure element and a first spring inserted in said stepped socket opposite to said front sleeve and firmly secured therein by a holder which comprises an outer thread on its one end;

two L-shaped couplers, each having a bolt hole at its one end for the connection with the outer thread of said connector, a sleeve portion at its other end for inserting in a cross rod, a quarter turn in the middle having a T-shaped positioning hole thereon;

an elongated circular cross rod having boring bore through its central axis for the insertion therein of the sleeve portion of said two L-shaped couplers from its both ends to connect said two L-shaped couplers together;

two supporting rods comprising each a pull rod having a ball head, an upper key hole notch, and a lower key bole notch;

two circular suspension rods having each a ball head at its both ends;

two upper struts comprising each a ball head portion, a projecting block and a key hole notch., two lower struts comprising each a ball head portion, a projecting block, a key hole notch, and a lever bracket; and a toothbrush holder comprising an axle received in a transparent cylindrical shell and having thereon two holder plates for holding toothbrushes, a block on its top top end for the connection thereto of a hook bolt to secure an upper cap to the top end of said transparent cylindrical shell and an outer thread on its lower end for the connection thereto of a knob to secure a bottom cap to the bottom end of said transparent cylindrical shell;

wherein said two fastening are respectively secured to a wall by screw nails for the connection thereto of said two connectors, said two couplers being respectively connected to said two connectors with said cross rod connected therebetween for the mounting thereon of two frame plates by means of sleeve-joint, said two supporting rods being bilaterally secured to said two L-shaped couplers with the ball heads of the pull rods thereof respectively retained in the T-shaped positioning hole of said two L-shaped couplers, said two upper struts being bilaterally secured in the upper key hole notch of said two supporting rods by means of the ball head portions thereof with the projecting blocks thereof respectively stopped against said two supporting rods, said two lower struts being bilaterally secured in the lower key hole notch of said two supporting rods by means of the ball head portions thereof with the projecting blocks thereof respectively stropped against said two supporting rods and with the lever brackets thereof stopped against said wall, said two circular suspension rods being respectively connected between said two upper struts and said two lower struts with the ball heads thereof respectively retained in the key hole notches to said upper and lower struts, and said toothbrush holder being hung on either one of said L-shaped couplers by means of its hook bolt.

2. A rack assembly as claimed in claim 1, wherein the steel balls of said connector are forced to partly protrude beyond the pivot holes thereof to seat in the circular grooves of said two fastening elements to secure the engagement of said two connectors with said two fastening elements.

3. A rack assembly as claimed in claim 1, wherein said L-shaped couplers comprise each a quarter turn having a positioning hole thereon for the insertion therein of a screw bolt to secure said supporting rods.

4. A rack assembly as claimed in claim 1, wherein said supporting rods comprise each two notches thereon each of which is comprised of a larger opening at the top, a smaller opening at the bottom, and a downward reducing neck portion in the middle to communicate said larger opening with said smaller opening, such that the ball head of each of said two suspension rods can be directly inserted in said notch from said larger opening and pressed downward through said reducing neck portion into said smaller opening to become firmly retained therein.

5. A rack assembly as claimed in claim 1, wherein said toothbrush holder comprises two access doors respectively connected to the transparent cylindrical shell thereof by means of bent portions which are unitarily made on said transparent cylindrical shell, said two access doors comprising each a hand-hold for the holding of the hand.

6. A rack assembly as claimed in claim 1, wherein said fastening elements are respectively secured to a wall by means of screw nails through the fastening holes thereof.

7. A rack assembly as claimed in claim 1, wherein the fastening angle of the screw nails which secure said two fastening elements to a wall does not affect the connection of said two connectors to said fastening elements.

* * * * *